US005588857A

United States Patent [19]

Feldmeier et al.

[11] Patent Number: 5,588,857

[45] Date of Patent: Dec. 31, 1996

[54] CENTERING SPRING SUPPORT FOR PANEL MOUNT CONNECTORS

[75] Inventors: Günter Feldmeier, Lorsch; Christian Schrettlinger, Bensheim, both of Germany

[73] Assignee: The Whitaker Corporation, Wilmington, Del.

[21] Appl. No.: 362,319

[22] Filed: Dec. 22, 1994

[30] Foreign Application Priority Data

Jan. 4, 1994 [GB] United Kingdom ..... 9400024

[51] Int. Cl.[6] ..... H01R 13/64

[52] U.S. Cl. ..... 439/248; 248/74.2

[58] Field of Search ..... 439/247, 248; 248/74.2

[56] References Cited

U.S. PATENT DOCUMENTS

| | | | |
|---|---|---|---|
| 2,753,141 | 7/1956 | Weber | 248/27 |
| 2,966,654 | 12/1960 | Hubell et al. | 339/133 |
| 3,358,866 | 12/1967 | Kinney | 220/3.9 |
| 4,566,660 | 1/1986 | Anscher et al. | 248/74.2 |
| 5,049,092 | 9/1991 | Takano et al. | 439/540 |
| 5,080,611 | 1/1992 | Hypes | 439/567 |
| 5,249,978 | 10/1993 | Gazda et al. | 439/246 |

FOREIGN PATENT DOCUMENTS

| | | |
|---|---|---|
| 1100702 | 9/1955 | France . |
| 4413001 | 10/1994 | Germany . |

*Primary Examiner*—Neil Abrams
*Assistant Examiner*—Eugene G. Byrd

[57] ABSTRACT

A connector for mounting to a panel is provided with a pair of centering springs mounted on opposed ends of the connector to support platforms facing in opposed directions. The centering spring is a unitary stamped and formed sheet metal part comprising a U-shaped base section and a resilient centering section having concave portions for fitting around a cylindrical shaft of a mounting screw. Mounting off the connector to the panel is accomplished by first urging the screw cylindrical shaft between the resilient section until it is seated between the concave portion of the centering spring. The connector can then be screwed onto the panel until a bush thereof abuts the panel, thereby allowing floating movement of the connector. Movement of the connector with respect to the panel is countered by the centering spring.

8 Claims, 4 Drawing Sheets

FIG. 3
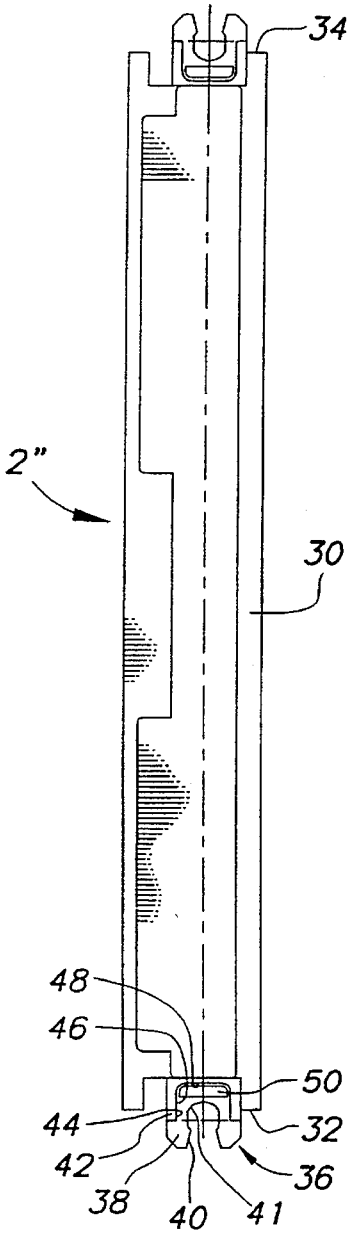
FIG. 4
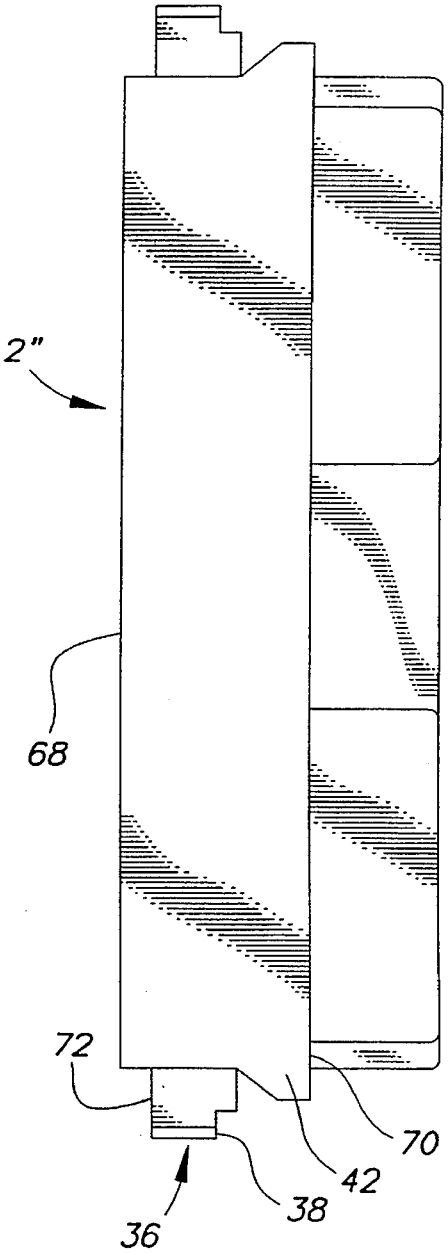
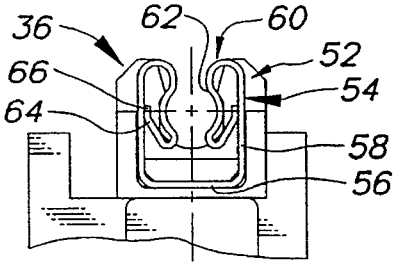
FIG. 5
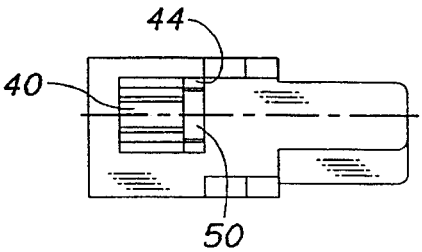
FIG. 6

CENTERING SPRING SUPPORT FOR PANEL MOUNT CONNECTORS

BACKGROUND OF THE INVENTION

1. Field of the Invention

This invention relates to resilient centering spring supports for resiliently maintaining panel mounted connectors in a central position with respect to a cutout in the panel.

2. Description of the Prior Art

It is common to find in the telecommunications industry, connectors having a large plurality of cables connected thereto, mounted to panels and matable with complementary connectors mounted on printed circuit boards. The panel may be a backpanel within a cabinet-like structure, the printed circuit boards being disposed perpendicularly thereto, whereby the connectors are blindly coupled by sliding the printed circuit boards into the cabinet until the connectors are mated. This means that the connectors must be precisely positioned with respect to each other. Construction of the backpanel and cabinet, sliding movement of the printed circuit board, and mounting of the connectors thereon all adds to the inaccuracy in the relative positioning of the mating connectors which therefore means that the mating connectors must enable coupling with a relatively large tolerance in the relative positioning. By floatably mounting the backpanel connectors within cutouts of the backpanel one could account for the tolerances required, but a further problem emanates from the connectors' heavy loading due to the mass of conducting wires connected thereto, thereby pulling the connector downwards. The connector would therefore be in a non-central position with respect to the panel cutout and subsequently with respect to the mating connector, thereby making coupling therebetween impossible or giving rise to excessive load on the connectors.

Connectors having resilient centering means and which are mounted to panels or similar structures, are known in U.S. Pat. No. 4,647,129 and in U.S. Pat. No. 4,815,984. Both of these connectors have centering means which comprise resilient arms integrally moulded with the connector housing and attached at their free ends to the structure or panel, the connector body thus being able to resiliently bias with respect to the panel or structure. Such a connector is however not well adapted to the connectors mentioned above used in the telecommunications industry, because on one hand, of insufficient spring force of the integral plastic arms for connectors having such a large number of terminals, and on the other hand plastic material with high resiliency may not correspond to the material best suited for producing such connectors. A further disadvantage of the latter, is the requirement to replace the whole connector should the support arms break.

SUMMARY OF THE INVENTION

It is therefore an object of this invention to provide a strong and reliable resilient centering support means for panel mount connectors.

It is a further object of this invention to provide a reliable and cost effective centering support means for large panel mount connectors.

An object of this invention has been achieved by providing a connector mountable to a panel with screw means, the connector moveable with respect to a panel cutout therefor, the connector having means for resilient biasing thereof towards the central position with respect to the panel cutout whereby the resilient means comprises a unitary stamped and formed sheet metal part mountable around the screw means.

BRIEF DESCRIPTION OF THE DRAWINGS

FIG. 3 is a bottom view of another embodiment of this invention showing support platforms of centering means;

FIG. 4 is a side view of the embodiment of FIG. 3;

FIG. 5 is a partial bottom view of the support platform of the embodiment of FIG. 3, comprising a centering spring mounted therein;

FIG. 6 is an end view of the embodiment of FIG. 4;

DETAILED DESCRIPTION OF THE PREFERRED EMBODIMENT

Figures 1, 1A:
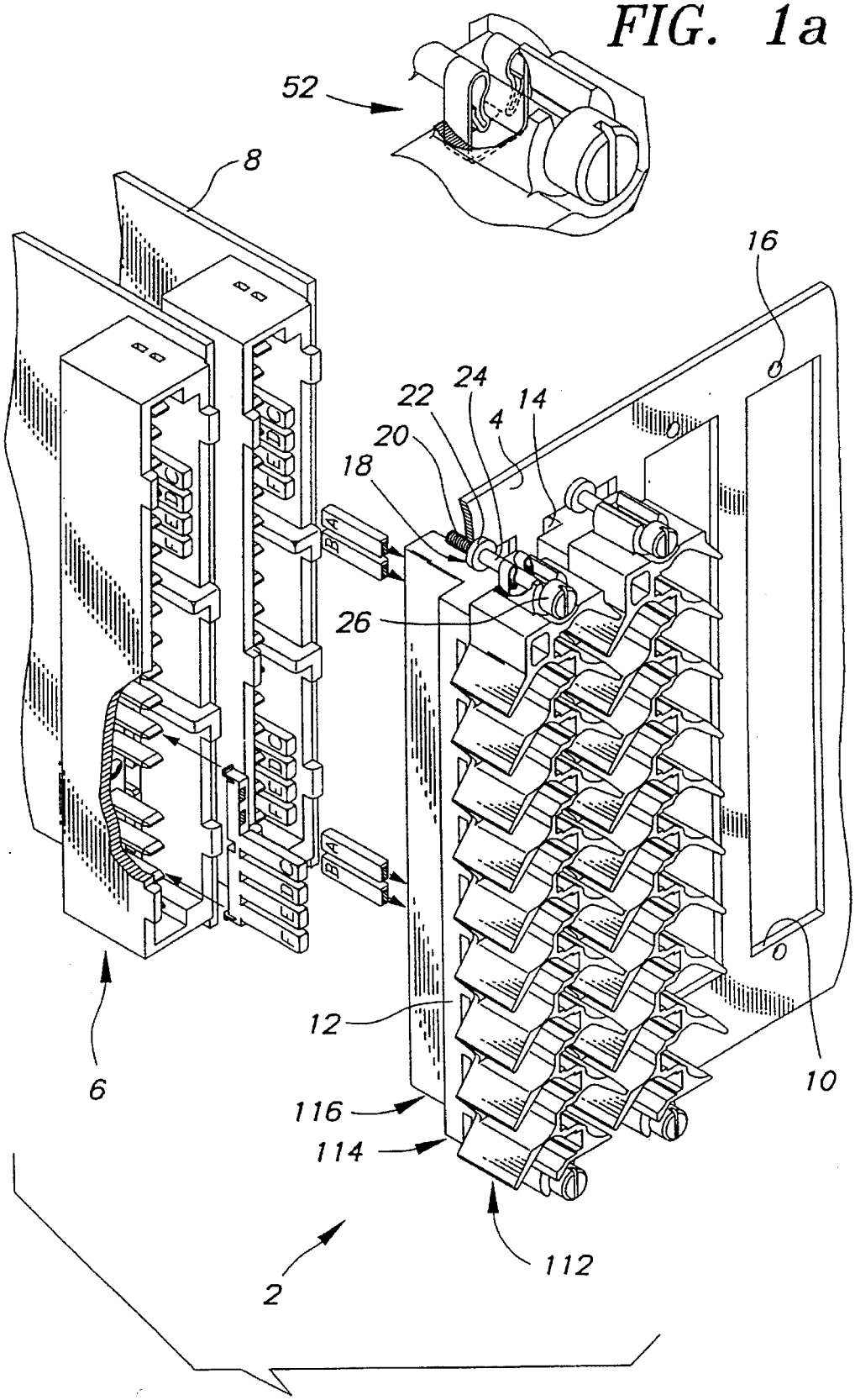
FIG. 1 is a partial isometric view of some panel mounted connectors about to be coupled to complimentary connectors mounted on printed circuit boards, and FIG. 1*a* an enlarged view of panel mounting means.

With reference to FIG. 1, panel mount connectors 2 are shown mounted to a backpanel 4, and printed circuit board (PCB) mounted connectors 6 are mounted onto PCBs 8 and are about to be coupled together. The panel 4 comprises rectangular cutouts 10 through which are mounted the panel connectors 2 having a central body section 12 that is opposite but spaced with a certain tolerance gap 14 from the cutout 10 thereby allowing a certain amount of floating movement of the connector 2 with respect to the panel 4. Disposed just off either end of the longitudinal cutout 10, are threaded holes 16 for receiving screws 18 having a threaded portion 20 extending into a larger diameter bush 22 which extends into a cylindrical portion 24 and finally ends in a screw head 26.

Figure 2:
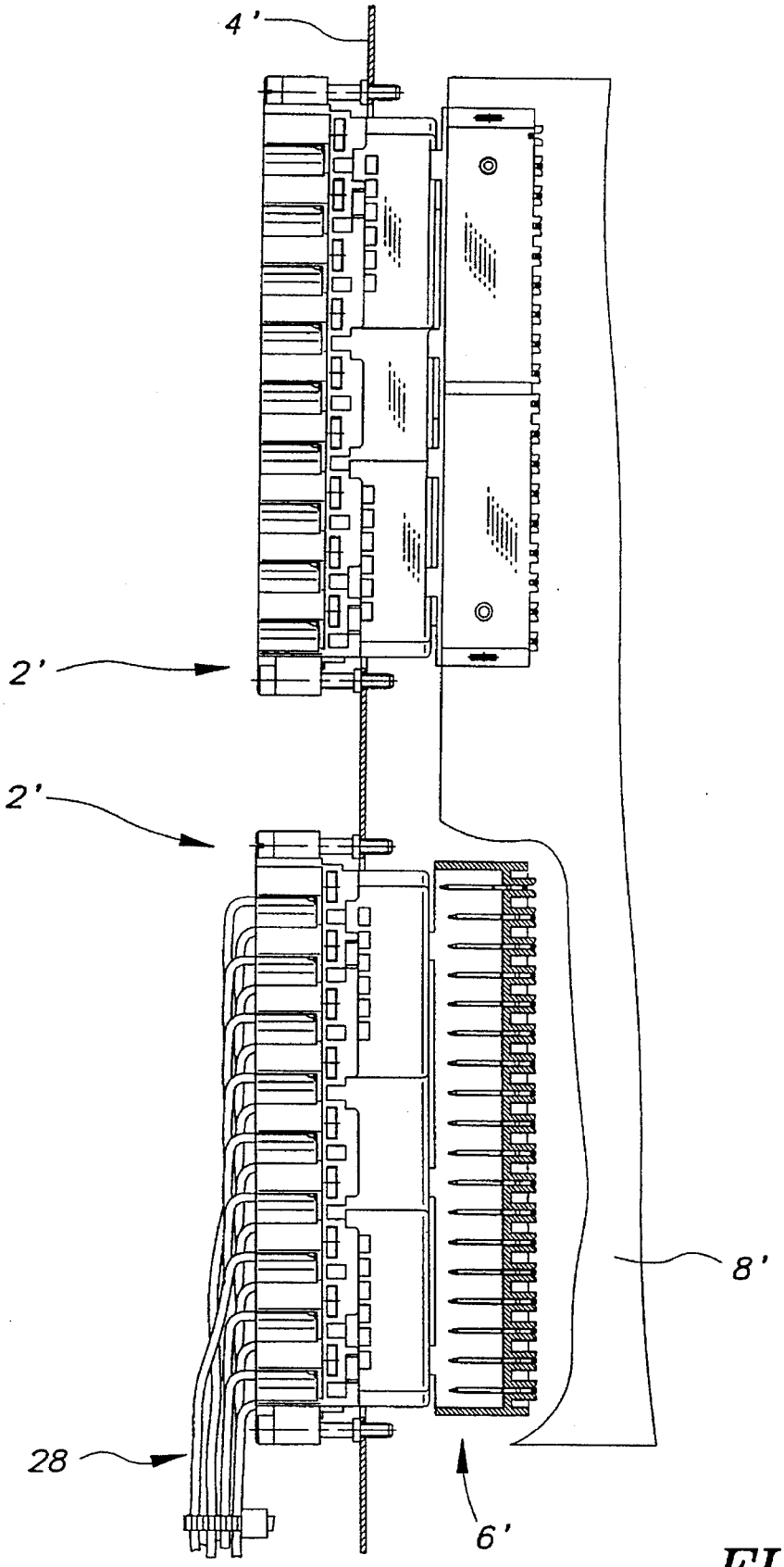
FIG. 2 is a partial cross-sectional view through a pair of connectors mounted on a printed circuit board and about to be coupled to a complimentary pair of connectors mounted to a backpanel.
Figure 7:
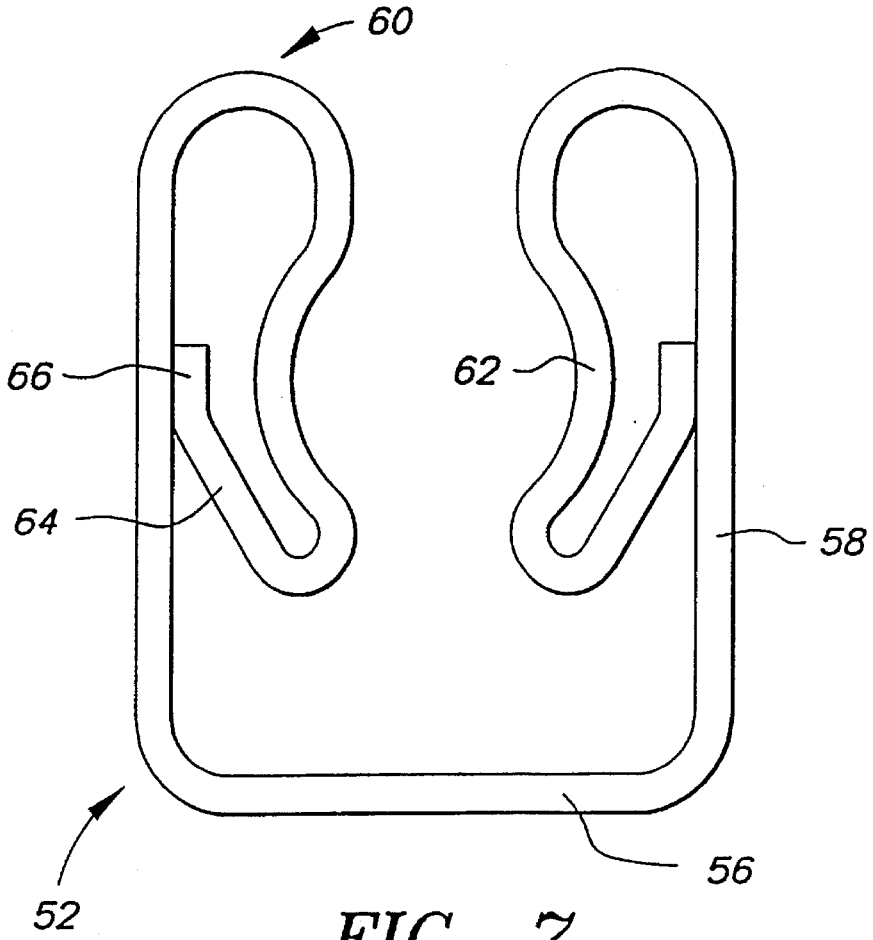
FIG. 7 is a top view of the centering spring.
Figure 8:
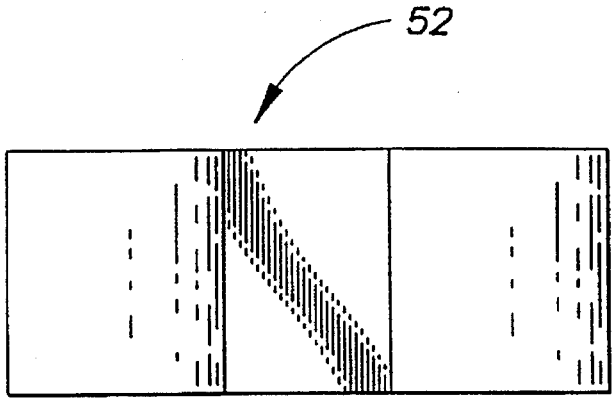
FIG. 8 is a view in the direction of arrow 8 of FIG. 7.

Referring now to FIG. 2 another disposition of connectors are shown, whereby pairs of connectors 2' are mounted to a backpanel 4' one above the other, and mate with a pair of connectors 6' mounted on a printed circuit board 8'. A plurality of conducting wires 28 are shown connected to one of the connectors 2'.

Referring to FIG. 3, another panel mount connector embodiment 2" is shown with some details removed, comprising an elongate insulative housing 30 having at opposing ends 32, 34 integral centering spring support platforms 36. The support platforms 36 comprise a horizontal base section 38 having a keyhole shaped cutout 40, and extending orthogonally therefrom a U-shaped wall 42 forming a U-shaped recess 44 for receiving a centering spring. The U-shaped recess 44 comprises side walls 46 and base wall 48. Spaced slightly apart from the base wall 48 is a retention wall 50.

Referring now to FIG. 5, a centering spring 52 is shown mounted on the support platform 36, the centering spring member 52 comprising a U-shaped base section 54 having a base portion 56 and lateral portions 58 extending orthogonally therefrom into inwardly folded resilient mouth sections 60. The resilient section 60 comprises concave portions 62 for closely fitting around the cylindrical portion 24 of the screws 18, the concave portion 62 extending into reversely bent spring arms 64 that are resiliently biased at a free end 66 against the centering spring lateral portions 58. The centering spring 52 is a unitary part stamped and formed from sheet metal and assembled to the support platform of the connector by urging the centering spring base portion 56 between the base wall 48 and retention wall 50 of the connector support platform 36, the spacing therebetween such that there is an interference fit. The centering spring lateral walls 58 are supported along most of the length by the lateral walls 46 of the support platform 36.

Referring now to FIGS. 4 and 6, the support platform 36 is shown approximately midway between a terminal receiving face 68 and a panel mount face 70 of the connector 2". The supporting platform 36 comprises a face 72 at an opposing end thereof to the centering spring receiving face 38.

In order to mount the connector 2" to the panel 4, the screws 18 must first be mounted to the connector by urging the cylindrical portion 24 of the screw between the resilient mouth section 60 of the centering spring, the mouth section 60 being biased apart thereby enabling the cylindrical portion 24 to seat itself between the opposing concave portions 62 of the centering spring. The keyhole recess 40 within the support platform 36 serves not only to guide the cylindrical portion 24 of the screw 18, but also prevents excessive strain of the centering spring by limiting deflection thereof. The connector 2" can then be mounted to the panel 4 by aligning the connector with the panel cutout 10 and tightening the screws 18 in the threaded hole 16 until the bush 22 abuts the panel (see FIG. 1). The position of the bush 22 is such that the distance between the screw head 26 and the panel 4 is slightly larger than the distance between the support platform screw head face 72 and the connector mounting face 70 thereby preventing tightening down of the connector 2" onto the panel 4 to enable movement therebetween.

As can be seen in FIG. 2, the large number of cables 28 which have a considerable mass, will tend to pull the connector down until the connector end abuts the panel cutout end wall. The latter is however avoided by the centering springs 52 which bias the connector to a central position within the panel cutout, which corresponds to the cylindrical portion of the screw 18 centrally disposed between the concave sections 62 of the centering spring member 52. Movement of the connector along it's longitudinal axis, will urge the cylindrical section 24 out of alignment with the concave surfaces 62, into the narrower portions which resiliently bias outwards and produce a force component tending to re-centre the centering spring member 52 with respect to the screw cylinder 24. Movement orthogonal to the longitudinal direction of the connector will cause one or the other of the concave portions 62 to resiliently bias towards the corresponding lateral portion 54 thereby producing a force tending to centre the centering spring member 52 with respect to the screw shaft 24. Excessive displacement in any of the directions will butt the screw shaft 24 against the keyhole inner arcuate contour 41 thereby protecting the centering spring from over-bending and limiting movement of the connector 2".

Coupling of a complementary connector 6 to the connector 2" can therefore be accomplished with a certain tolerance in the relative positioning, allowed by movement of the centering spring member 52 around the screw shaft 24 as described above. The resiliency of the centering spring 52 is chosen such that the weight of the conducting cables 28 does not cause the keyhole inner arcuate surface 41 to be urged against the screw shaft 24, thereby maintaining the connector 2" in as central a position as possible with respect to the panel cutout 10.

Advantageously, the centering spring 52 as described above is simple to manufacture due to the unitary stamped and formed simple sheet metal part, yet provides a reliable and strong spring force required for centering large connectors mounted to a panel and having a relatively large number of conducting wires suspended therefrom. Further advantageously, is the protection from overstraining the centering spring by the keyhole profiled cavity of the support platform, which additionally limits movement of the connector with respect to the panel.

We claim:

1. An electrical connector securable to a panel, and being movable with respect to the panel, the connector being characterized in that the connector comprises a securing member comprised of a resilient centering spring member and a separate fastener member, said spring member cooperable with the fastener member for flotably securing said connector to the panel, and biasing said connector toward a central axial position with respect to the panel.

2. The electrical connector of claim 1 characterized in that the spring member comprises a unitary stamped and formed sheet metal part mountable around the fastener member.

3. The electrical connector of claim 1 characterized in that the connector comprises a pair of the centering spring members mounted on opposing ends thereof and facing in opposing directions.

4. The electrical connector of any one of claims 1,3 or 2 characterized in that the centering spring member comprises a U-shaped base section, and extending from either end thereof is a pair of resilient sections bent inwardly into the U-shape and comprising arcuate portions for close fitting about the cylindrical screw means.

5. The electrical connector of claim 4 characterized in that the resilient section of the centering spring member comprises reversely folded support portions extending from the arcuate portions, the support portions resiliently biased against the base support section for increasing the resilient force of the resilient section.

6. The electrical connector of claim 1 characterized in that the connector comprises platforms for mounting the centering spring members thereon, the platforms comprising a U-shaped recess for receiving the centering spring base section substantially thereagainst.

7. The electrical connector claim 6 characterized in that the connector centering spring platform comprises an upstanding wall within the U-shaped recess and forming a gap therebetween for receiving the U-shaped base section of the centering spring member for retention thereof.

8. The electrical connector of claim 2 characterized in that the fastener means comprise screw means, these screw means comprising a bush to prevent tightening down of the screw head on the connector thereby allowing floating movement thereof parallel to the panel.

* * * * *